US011259658B2

(12) United States Patent
Cherewaty, Jr.

(10) Patent No.: US 11,259,658 B2
(45) Date of Patent: Mar. 1, 2022

(54) BOWL RAMP

(71) Applicant: Stephen N. Cherewaty, Jr., Everett, WA (US)

(72) Inventor: Stephen N. Cherewaty, Jr., Everett, WA (US)

( * ) Notice: Subject to any disclaimer, the term of this patent is extended or adjusted under 35 U.S.C. 154(b) by 161 days.

(21) Appl. No.: 16/553,819

(22) Filed: Aug. 28, 2019

(65) Prior Publication Data

US 2020/0100608 A1 Apr. 2, 2020

Related U.S. Application Data

(60) Provisional application No. 62/737,425, filed on Sep. 27, 2018.

(51) Int. Cl.
*A47G 19/08* (2006.01)
*A47G 19/30* (2006.01)

(52) U.S. Cl.
CPC ..... *A47G 19/08* (2013.01); *A47G 19/30* (2013.01)

(58) Field of Classification Search
CPC .. B65D 25/105; B65D 5/6673; B65D 5/6647; B65D 5/6611; B65D 5/643; B65D 5/4283; A47G 19/02; A47G 19/08; A47G 19/12; A47G 19/30; A47G 19/04
See application file for complete search history.

(56) References Cited

U.S. PATENT DOCUMENTS 2,719,414 A * 10/1955 Davis ..... A47G 23/0225 220/738
4,961,555 A * 10/1990 Egan, Jr. ..... A47G 23/0225 211/41.2
5,518,211 A * 5/1996 Gaskill ..... A47J 43/287 211/120
6,682,034 B1 * 1/2004 Vial ..... A47G 19/04 248/231.81
2003/0080127 A1 * 5/2003 Gibert ..... A47G 19/04 220/23.4
2004/0245251 A1 * 12/2004 Heng ..... B65D 43/022 220/234
2009/0250474 A1 * 10/2009 Malcolm ..... A47G 19/02 220/574.1
2015/0239616 A1 * 8/2015 Henry ..... A47G 23/0225 220/751
2015/0366388 A1 * 12/2015 Goldstein ..... B65D 85/72 220/737
2016/0374506 A1 * 12/2016 Bui ..... A47J 36/12 220/744

* cited by examiner

*Primary Examiner* — Kareen K Thomas
(74) *Attorney, Agent, or Firm* — Christopher Mayle; Bold IP, PLLC

(57) ABSTRACT

A device attached to a service dish whereby the user of the device facilitates dip from the serving dish, applying the edge of a dipping food such as chips or crackers to a ramp portion of the device positioned on the inside of the serving dish wherein the dip may be manipulated into a secure position on the dipping food without the user touching the dip with their bare hand.

19 Claims, 3 Drawing Sheets

BOWL RAMP

CROSS REFERENCE TO RELATED APPLICATIONS

This application claims priority to a prior-filed provisional application Ser. No. 62/737,425 filed on Sep. 27, 2018.

FIELD OF THE DISCLOSURE

This invention relates generally to dishware for use in serving and consuming food items, and more particularly to a ramp device which can be secured to food service bowls.

BACKGROUND

Potlucks, parties, and other events are typified by an assortment of foods served in communally accessible dishware. In particular, hors d'oeuvres or other light snacks are commonly served in large communal dishware with available dips also in communal dishware. Dips, such as écarts de houmous (hummus spreads), pates assaisonnees (seasoned pastes), trempant compagnons (dipping companions), or saveurs mélangées (blended flavors) as well as sauces or salsas, are typically utilized by a user dipping their food into the dip with their bare hands.

This manner of serving dips presents both a utilitarian and hygienic problem. As dips vary in viscosity, a user may desire to coat their dipping food, for example chips, with the dip and maintain the dip on the dipping food. Additionally, a user may manually apply dip to a dipping food with their bare hand to keep the dip from falling off the dipping food. While fondues approach this problem by generally involving a long-handled fork or skewer by which a user may secure dip to their food, common dipping accompaniments or accoutrements listed above require an alternative solution.

SUMMARY

The present invention is directed to an apparatus for facilitating dip removal form a serving dish comprising, a ramp portion placed against an interior sidewall of the serving dish, wherein the ramp portion extends upwards and curves towards the center of the serving dish, further comprising, a handle attached to the backside of the ramp portion, the ramp portion connected to a retention clamp at a pivot point, the retention clamp having a recurved portion that curls around a top edge of the serving dish and is configured to bias the retention clamp against the serving dish, the retention clamp having an upward extension configured to operate as second handle for the user to grip, wherein the first and the second handle are configured to open the retention clamp so as to position the retention clamp on the serving dish, further comprising, one or more clefs along the recurved portion of the retention clamp, the one or more clefs configured to accommodate a serving utensil, the apparatus comprised of an elastomeric material, wherein the pivot point is a hinge or wherein the pivot point is an arch.

The present invention is also directed to an apparatus for facilitating dip removal form a serving dish comprising a ramp placed against an interior sidewall of the serving dish, wherein the ramp portion extends upwards and transitions into a tapered lip, the tapered lip curving to the center of the serving dish, further comprising, a handle configured for a user to grip, the handle attached to the backside of the ramp, the ramp connected to a retention clamp at a pivot point between the ramp portion and the retention clamp, the retention clamp having an upward extension configured to operate as second handle for the user to grip, wherein the first and the second handle are configured to open the retention clamp so as to position the retention clamp on the serving dish, the ramp having an interior rigid structure, the retention clamp having a recurved portion curling around a top edge of the serving dish, the recurve portion configured to bias the retention clamp against the serving dish, further comprising, one or more clefs along the recurved portion of the retention clamp, the one or more clefs configured to accommodate a serving utensil, the apparatus comprised of an elastomeric material, the elastomeric material is polypropylene or polystyrene, wherein the pivot point is a living hinge or an arch

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of select embodiments and not all possible implementations and are not intended to limit the scope of the present disclosure.

DETAILED DESCRIPTION

Figure 1:
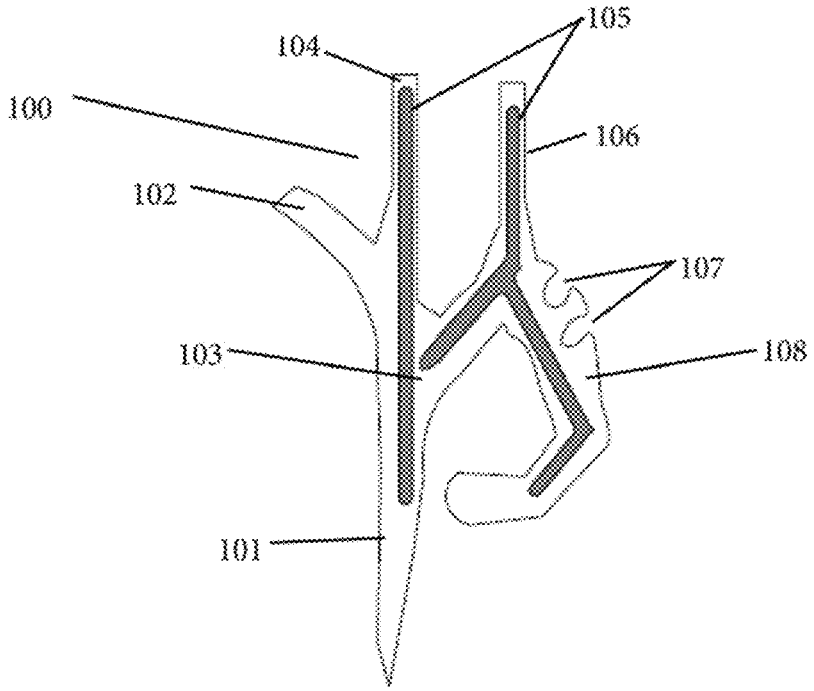
FIG. 1 is a side view of an embodiment for a bowl ramp.
Figure 2:
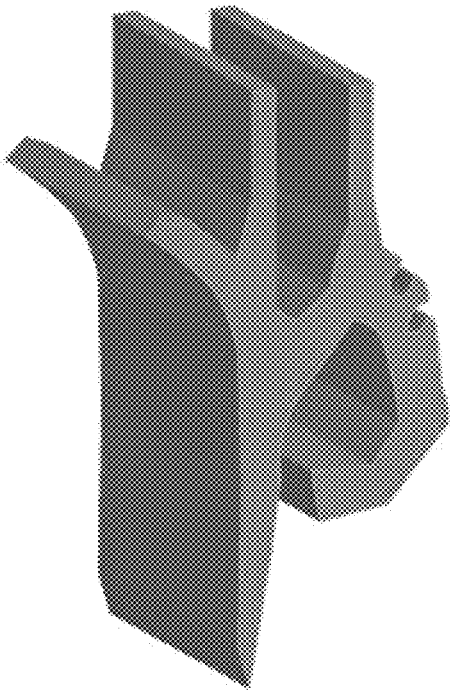
FIG. 2 is a perspective view of an embodiment for a bowl ramp.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and the upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present invention facilitates a device by which a user of the device may ensure that dip applied on the edge of a dipping food can be manipulated into a secure position on the dipping food without the user manipulating the dip with their bare hand. In a preferred embodiment, a bowl ramp is constructed out of a material safe to contact foods and with sufficient elasticity to grip the edge of a serving dish, such as a bowl. The bowl ramp may be dishwasher safe or disposable.

For the dishwasher safe embodiment, the bowl ramp would ideally be made from elastomeric food grade silicone (e.g. Qμ 260/230 silicone). This version would include a rigid inner structure with high durometer silicone on the exterior of the bowl ramp. The rigid inner structure may be separated into two components. The first component provides rigidity for a dip ramp for positioning within the interior volume of a bowl and may be substantially linear to facilitate ramp rigidity. The second component provides rigidity for gripping means of the bowl ramp against the exterior surface of a bowl and may be substantially y-shaped. The second component's y-shape is to facilitate a pivot point relative to the linear component, a gripping handle, and rigidity for the clip to grip the exterior surface of the bowl.

For the disposable embodiment, the bowl ramp would ideally be made from low-cost elastomeric materials, for example polypropylene or polystyrene. Such an elastomeric material would be suitable for maintaining structural rigidity to function as a dip ramp and to provide gripping and clamping means as well as sufficient flexibility to accommodate some structural deformation at the pivot point while a user positions the bowl ramp by way of the vertical handles and outer retention clamp.

The elastomeric materials are suitable for use as a spring at the pivot point of the bowl ramp. This pivot point is approximately positioned between the dip ramp for placement within the interior volume of a serving dish and the combination handle and gripping means for placement along the exterior surface of the serving dish. The pivot point of one embodiment of the disposable bowl ramp utilizes a living hinge to bias the clamp against the edge of a serving dish. The pivot point of another embodiment of the disposable bowl ramp utilizes an arch to bias the clamp against the edge of a serving dish.

In preferred embodiments, the bowl ramp includes a contoured ramp for placing within the interior volume of a serving dish for dip. The ramp would curve inwards towards the center of the bowl so that sauces and dips on a dipping food are kept on the dipping food and do not fall outside of the bowl. The contoured ramp is attached to an outer retention clamp at a pivot point. The pivot point may be defined as the region where two rigid interior structures are in proximity to each other and otherwise joined by an elastomeric material, a living hinge, or an arch. The retention clip includes a vertical member for a user to grip the bowl ramp and a recurved structure for biasing the retention clamp towards the ramp thereby clamping the bowl ramp to a serving dish. The recurved structure may include clefts or similar means for a user to fit spoons or other utensils.

Referring initially to FIG. 1, a side view of an embodiment for a bowl ramp 100, a rigid structure 105 defines the general shape of two component halves of the bowl ramp 100. A first half of the bowl ramp 100 is a dipping food ramp 101 that extends upward and transitions into a tapered lip 102. The ramp 101 may be positioned against an interior sidewall of a serving dish. The tapered lip 102 curves inward toward the center of the serving dish the ramp 101 is positioned against. The ramp 101 is made rigid by the interior rigid structure 105, substantially extending vertically to terminate in a gripping handle 104. A second half of the bowl ramp 100 is the retention clamping arm 108, shaped to curve around the edge of the serving dish and biased towards the exterior sidewall of the serving dish. The retention clamping arm 108 has a vertical extension to provide a second gripping handle 106. A user may press the first gripping handle 104 and the second gripping handle 106 together to open the clamp so as to position the clamp on a serving dish. Opening the clamp is facilitated by the elastomeric material covering the bowl ramp 100 at the pivot point 103 where the rigid structure 105 of the two halves of the bowl ramp are not attached. Spoons or other serving utensils may be stored on the bowl ramp 100 by means of the horizontal clefts 107.

Figure 3:
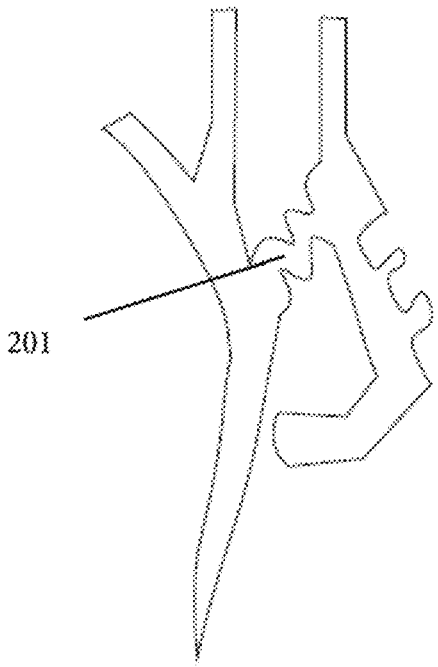
FIG. 3 is a side view of an embodiment for a bowl ramp.
Figure 4:
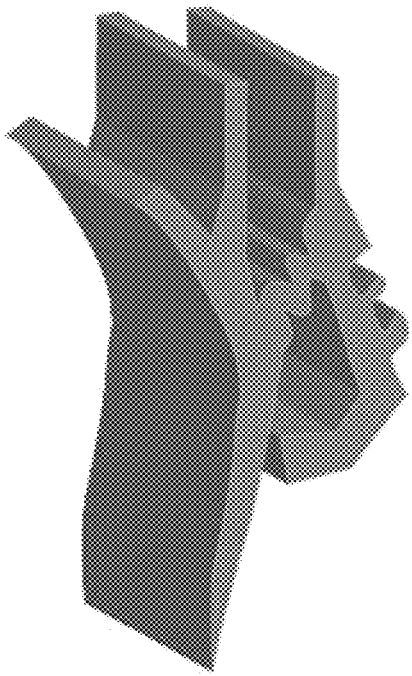
FIG. 4 is a perspective view of an embodiment for a bowl ramp.
Figure 5:
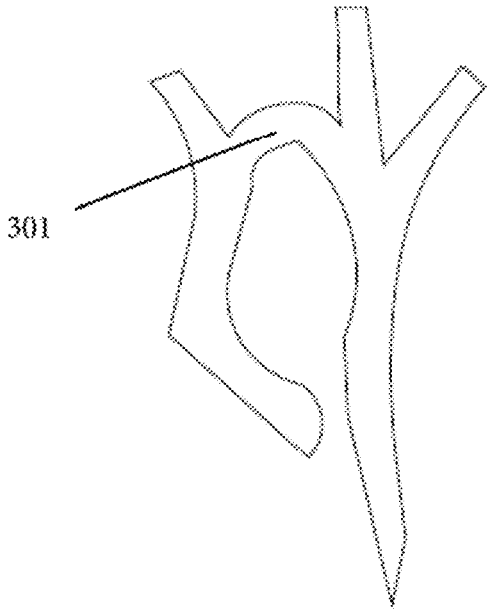
FIG. 5 is a side view of an embodiment for a bowl ramp.
Figure 6:
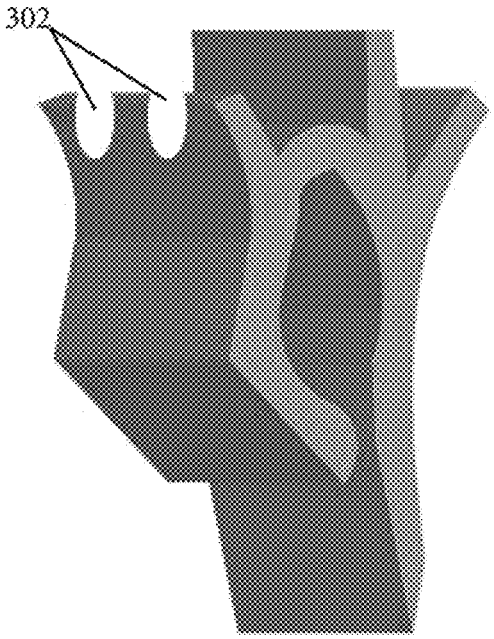
FIG. 6 is a perspective view of an embodiment for a bowl ramp.

The pivot point 103 may be facilitated by other means than a rigid structure 105 joined by elastomeric material. Referring to FIG. 3, the pivot point may be defined by a living hinge 201. In another embodiment and referring to FIG. 5, the pivot point may be defined by an arch 301. As shown in FIG. 6, clefts 302 in the retention clamp may be vertically orientated.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus for facilitating dip removal from a serving dish comprising:

a ramp portion placed against an interior sidewall of the serving dish, the ramp portion connected to a retention clamp at a pivot point.

2. The apparatus of claim 1, wherein the ramp portion extends upwards and curves towards a center of the serving dish.

3. The apparatus of claim 2 further comprising, a handle attached to a backside of the ramp portion.

4. The apparatus of claim 1, the retention clamp having a recurved portion that curls around a top edge of the serving dish and is configured to bias the retention clamp against the serving dish.

5. The apparatus of claim 4, the retention clamp having an upward extension configured to operate as a second handle for a user to grip, wherein a first and the second handle are configured to open the retention clamp so as to position the retention clamp on the serving dish.

6. The apparatus of claim 5 further comprising, one or more clefs along the recurved portion of the retention clamp, the one or more clefs configured to accommodate a serving utensil.

7. The apparatus of claim 6, the apparatus comprised of an elastomeric material.

8. The apparatus of claim 1, wherein the pivot point is a hinge.

9. The apparatus of claim 1, wherein the pivot point is an arch.

10. An apparatus for facilitating dip removal from a serving dish comprising:

a ramp placed against an interior sidewall of the serving dish, wherein a ramp portion extends upwards and transitions into a tapered lip, the tapered lip curving to a center of the serving dish, and a retention clamp having one or more clefs along a recurved portion of the retention clamp, the one or more clefs configured to accommodate a serving utensil.

11. The apparatus of claim 10 further comprising, a handle configured for a user to grip, the handle attached to a backside of the ramp, the ramp connected to the retention clamp at a pivot point between the ramp portion and the retention clamp.

12. The apparatus of claim 10, the retention clamp having an upward extension configured to operate as second handle for a user to grip, wherein a first and the second handle are configured to open the retention clamp so as to position the retention clamp on the serving dish.

13. The apparatus of claim 10, the ramp having an interior rigid structure.

14. The apparatus of claim 10, the apparatus comprised of an elastomeric material.

15. An apparatus for facilitating dip removal from a dish comprising:

a ramp placed against an interior sidewall of the dish; and one or more clefs, the one or more clefs configured to accommodate one or more serving utensils.

16. The apparatus of claim 15 further comprising: a retention clamp.

17. The apparatus of claim 15, the ramp having an interior rigid structure.

18. The apparatus of claim 15, the apparatus comprised of an elastomeric material.

19. The apparatus of claim 15, wherein the ramp has a first portion extending upwards along the interior sidewall of the dish and a second portion extending upwards from the first portion, the second portion curving from the interior sidewall inwards to a center of a serving dish.

* * * * *